US009500086B2

(12) United States Patent
Takarai

(10) Patent No.: US 9,500,086 B2
(45) Date of Patent: Nov. 22, 2016

(54) IMPELLER AND ELECTRIC-MOTOR DRIVEN WATER PUMP HAVING THE SAME

(71) Applicant: Hitachi Automotive Systems, Ltd., Hitachinaka-shi, Ibaraki (JP)

(72) Inventor: Kenya Takarai, Honjo (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 309 days.

(21) Appl. No.: 14/022,809

(22) Filed: Sep. 10, 2013

(65) Prior Publication Data

US 2014/0086767 A1 Mar. 27, 2014

(30) Foreign Application Priority Data

Sep. 26, 2012 (JP) ..... 2012-211793
Mar. 11, 2013 (JP) ..... 2013-047669

(51) Int. Cl.
*F01D 5/14* (2006.01)
*F04D 29/22* (2006.01)
*F04D 13/06* (2006.01)

(52) U.S. Cl.
CPC ..... *F01D 5/143* (2013.01); *F04D 13/0606* (2013.01); *F04D 29/2227* (2013.01); *F05D 2230/232* (2013.01)

(58) Field of Classification Search
CPC ..... F01D 5/143; F04D 29/2227; F04D 13/0606; F04D 29/30; F04D 29/24; F05D 2230/10; F05D 2230/23; F05D 2230/40
See application file for complete search history.

(56) References Cited

U.S. PATENT DOCUMENTS 3,298,444 A * 1/1967 Haas ..... F01D 5/048 415/200
4,647,271 A * 3/1987 Nagai et al. ..... F04D 29/281 416/186 R
5,655,485 A * 8/1997 Kusase ..... F04D 13/0666 123/41.31
8,899,931 B2 * 12/2014 Nakaniwa ..... F04D 29/023 416/185
2008/0199319 A1 * 8/2008 Mause et al. ..... B29C 65/7802 416/185
2011/0286848 A1 * 11/2011 Rhodes ..... F04D 29/281 416/185
2011/0318183 A1 * 12/2011 Noronha et al. ..... B23P 15/006 416/189

FOREIGN PATENT DOCUMENTS

DE 3319641 A1 * 12/1984 ..... B23P 15/006
JP 2011-122457 A 6/2011

* cited by examiner

*Primary Examiner* — Charles Freay
*Assistant Examiner* — Thomas Cash
(74) *Attorney, Agent, or Firm* — Crowell & Moring LLP

(57) ABSTRACT

An impeller is comprised of a hub configured to be rotated on a central axis, a shroud formed to be opposed to the hub in a direction of the central axis and having a central opening serving as a fluid inlet, and a plurality of circumferentially-equidistant spaced blades interleaved between the hub and the shroud. When a mating face of the shroud with each of the blades is divided into a radially inward region and a radially outward region, and a mating face of each of the blades with the shroud is divided into a radially inward region and a radially outward region, a given weld range is set only in the radially inward region of the mating face of the shroud with each of the blades and the radially inward region of the mating face of each of the blades with the shroud.

6 Claims, 5 Drawing Sheets

IMPELLER AND ELECTRIC-MOTOR DRIVEN WATER PUMP HAVING THE SAME

TECHNICAL FIELD

The present invention relates to an impeller which can be applied to an electric-motor driven water pump.

BACKGROUND ART

In recent years, there have been proposed and developed various impeller manufacturing technologies in which a shroud and each impeller blade are welded or joined together by heating (e.g., ultrasonic-welding) their mating faces extending radially outward from the opening of the shroud. One such impeller manufacturing technology has been disclosed in Japanese Unexamined Patent Application Publication No. 2011-122457 (hereinafter is referred to as "JP2011-122457").

SUMMARY OF THE INVENTION

However, in the case of the impeller as disclosed in JP2011-122457, a portion of the mating face near the circumference of the shroud having a lower molding accuracy than the opening of the shroud is also included in a weld range. Hence, it is hard to achieve a high dimensional accuracy at the welded portion of the mating face near the circumference of the shroud. This leads to the problem of a large distortion of the mating face, in other words, a deteriorated welding accuracy.

Accordingly, it is an object of the invention to provide an impeller configured to ameliorate a welding accuracy of impeller parts welded together.

In order to accomplish the aforementioned and other objects of the present invention, an impeller comprises a hub configured to be rotated on a central axis, a shroud formed to be opposed to the hub in a direction of the central axis and having a central opening serving as a fluid inlet, and a plurality of circumferentially-equidistant spaced blades interleaved between the hub and the shroud, wherein, when a mating face of the shroud with each of the blades is divided into a radially inward region and a radially outward region, and a mating face of each of the blades with the shroud is divided into a radially inward region and a radially outward region, a given weld range is set only in the radially inward region of the mating face of the shroud with each of the blades and the radially inward region of the mating face of each of the blades with the shroud.

According to another aspect of the invention, an impeller comprises a hub configured to be rotated on a central axis, a shroud formed to be opposed to the hub in a direction of the central axis and having a central opening serving as a fluid inlet, and a plurality of circumferentially-equidistant spaced blades interleaved between the hub and the shroud, wherein, when a mating face of each of the blades with the hub is divided into a radially inward region and a radially outward region, and a mating face of the hub with each of the blades is divided into a radially inward region and a radially outward region, a given weld range is set only in the radially inward region of the mating face of each of the blades with the hub and the radially inward region of the mating face of the hub with each of the blades.

The other objects and features of this invention will become understood from the following description with reference to the accompanying drawings.

DESCRIPTION OF THE PREFERRED EMBODIMENTS

First Embodiment

Figure 1:
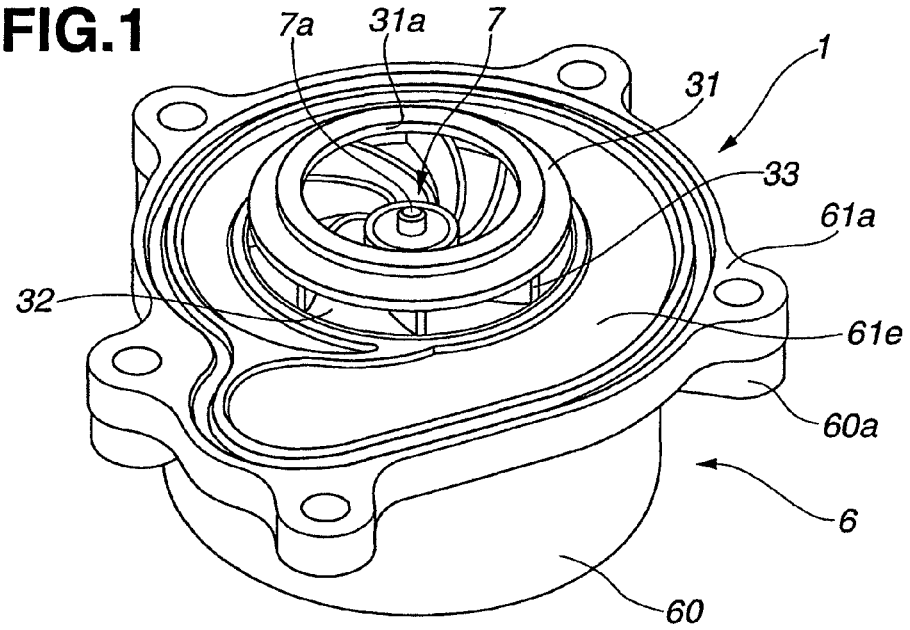
FIG. 1 is a perspective view illustrating a first embodiment of an electric-motor driven water pump having an improved impeller according to the invention.
Figure 2:
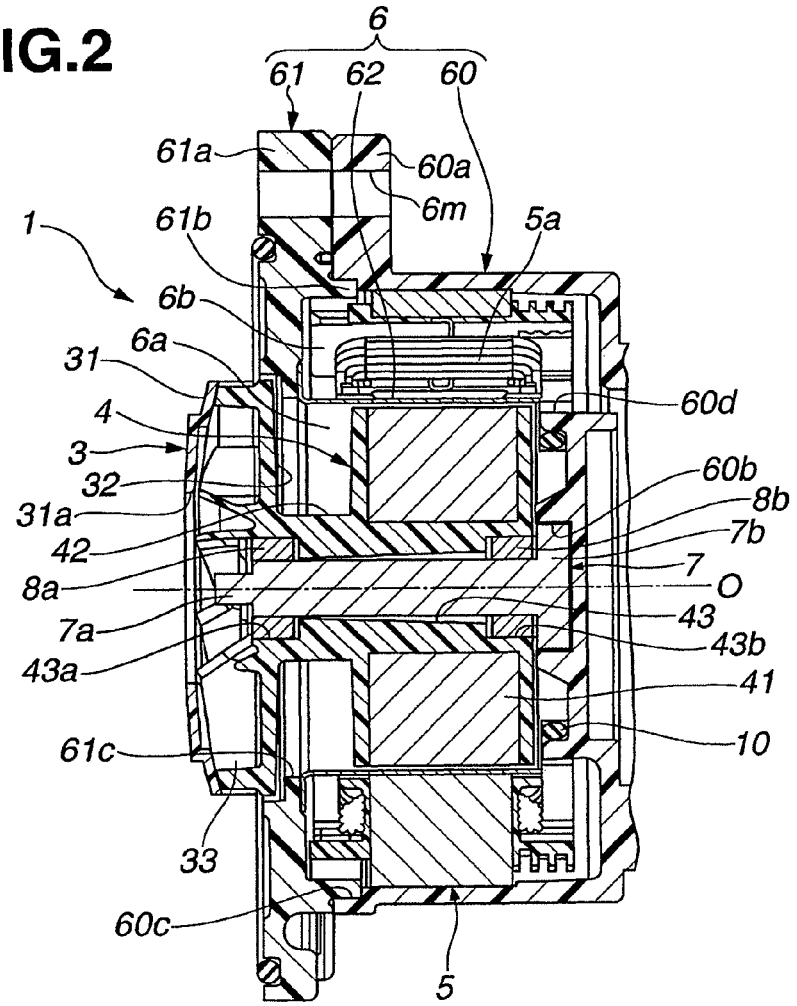
FIG. 2 is a longitudinal cross-sectional view illustrating the water pump of the first embodiment.

Referring now to the drawings, particularly to FIGS. 1 and 2, the electric-motor driven water pump 1 of the first embodiment is exemplified in a cooling-water supply source incorporated in a cooling system of an internal combustion engine for maintaining circulation of cooling water (coolant) of the engine.

Water pump 1 of the first embodiment is comprised of an impeller 3, a rotor 4, a stator 5, and a pump housing 6. Rotor 4 is formed integral with an impeller hub (simply, hub) 32 and a plurality of impeller blades (simply, blades) 33, constructing the impeller 3. Pump housing 6 is configured to accommodate or house therein the components 3, 4 and 5. In the shown embodiment, these components 3-6, constructing water pump 1, are mainly made of synthetic resin material. The structure and configuration of each of the components of water pump 1 are hereunder described in detail.

(Rotor)

Rotor 4 has a plurality of circumferentially equidistant-spaced permanent magnets 41 buried around the entire circumference of rotor 4. The two adjacent permanent magnets 41, 41 are arranged to have two opposite magnetic poles. Rotor 4 has a small-diameter portion 42, which is formed between the impeller 3 (exactly, an impeller hub 32 described later) and the rotor 4 and has a diameter smaller than the outside diameter of impeller 3.

Rotor 4 has a central through hole 43 formed to axially extend throughout its entire length containing the small-diameter portion 42. Both ends of central through hole 43 of rotor 4 are formed as bearing accommodation bores 43*a*-43*b*. A bearing 8*a* is press-fitted into the bearing accommodation bore 43*a*, whereas a bearing 8*b* is press-fitted into the bearing accommodation bore 43*b*.

(Stator)

Stator 5 is constructed by a plurality of stator coils 5*a*. As a whole, stator 5 is formed into a substantially cylindrical-hollow shape. Each of stator coils 5*a* is electrically connected to an electronic control unit (not shown) such that an electric power, which is determined depending on a target pump speed calculated during rotational speed control of water pump 1, can be supplied to each of the stator coils. In the shown embodiment, the electric motor, provided for driving the water pump 1, is constructed by a brushless motor having the rotor 4 and the stator 5.

(Housing)

Pump housing 6 is constructed by a substantially cylindrical-hollow housing member (a first housing member) 60, a lid member (a second housing member) 61, and a fluid-tight partition wall member 62.

The cylindrical-hollow housing member 60 has a large-diameter opening 60*c* (an axially-leftward opening end, viewing FIG. 2) for installing the water-pump components, such as stator 5 and fluid-tight partition wall member 62. The axially-leftward opening end of the cylindrical-hollow housing member 60 is formed with a radially-outward extending water-pump mounting flange 60*a* having a plurality of water-pump mounting-bolt holes. The right-hand partition wall section of housing member 60 is formed at its center with a substantially cylindrical shaft press-fit recess 60*b*, whose geometric center is identical to a central axis "O" of a shaft 7 (described later). Also, the right-hand partition wall section of housing member 60 has an annular protrusion 60*d* formed to slightly axially protrude leftward from its inside wall surface, facing the rotor 4, and integrally formed coaxially with the substantially cylindrical shaft press-fit recess 60*b*. A seal ring 10 is placed or fitted around the inner periphery of annular protrusion 60*d*.

Lid member 61 is formed into a substantially disk shape. One sidewall of lid member 61, facing the large-diameter opening 60*c* of housing member 60, has an annular protrusion 61*b* formed to slightly axially protrude rightward and configured to circumferentially extend along the inner periphery of the large-diameter opening 60*c*. The outer periphery of lid member 61 is formed with a radially-outward extending water-pump mounting flange 61*a* having a plurality of water-pump mounting-bolt holes. When mounting the water pump 1 on a cylinder block of the engine, the annular protrusion 61*b* of lid member 61 is fitted into the large-diameter opening 60*c* of housing member 60 and circumferentially positioned in place, such that the mounting-bolt holes of the housing member side and the mounting-bolt holes of the lid member side are circumferentially aligned with each other to provide axially-aligned water-pump mounting-bolt holes 6*m*. Then, water pump 1 is mounted by fastening these two housing members 60-61 together with bolts screwed into the engine block. Lid member 61 has a central opening 61*c* through which rotor 4 can be installed into an internal space of housing member 60. The inside diameter of central opening 61*c* of lid member 61 is dimensioned to be greater than the outside diameter of rotor 4, and also dimensioned to be less than the outside diameter of impeller 3. Also, the other sidewall of lid member 61, facing axially leftward apart from the large-diameter opening 60*c* of housing member 60, has a volute pump chamber 61*e* formed therein.

Fluid-tight partition wall member 62 is configured to partition an internal space, defined by the housing member 60 and the lid member 61, in a fluid-tight fashion. As a whole, fluid-tight partition wall member 62 is formed into a substantially cylindrical-hollow shape. The wall thickness of fluid-tight partition wall member 62 is dimensioned to be less than that of each of the housing member 60 and the lid member 61.

(Shaft Construction)

Impeller 3 and rotor 4 are rotatably mounted on the shaft 7. Shaft 7 is supported on the two bearings 8*a*-8*b* (described later). Shaft 7 is formed into a long cylindrical shape. Shaft 7 has a small-diameter portion 7*a* formed at the leftmost end (viewing FIG. 2) and a large-diameter portion 7*b* formed at the rightmost end (viewing FIG. 2). The central axis "O" of shaft 7 is a central axis (a rotation axis) common to both the impeller 3 and the rotor 4.

(Assembling of Pump Body)

First of all, stator 5 is installed or fitted onto the inner periphery of housing member 60 through the large-diameter opening 60*c*, and then fluid-tight partition wall member 62 is inserted and fitted onto the inner periphery of stator 5. The right-hand side radially-inward bent portion of fluid-tight partition wall member 62, together with the seal ring 10, is fitted onto the inner periphery of annular protrusion 60*d*. On the other hand, the left-hand side radially-outward bent portion of fluid-tight partition wall member 62 is fitted into and securely retained by the inside wall surface of the central opening 61*c* of lid member 61 (mounted and assembled later). The annular protrusion 61*b* of lid member 61 is fitted into the large-diameter opening 60*c* of housing member 60 and circumferentially positioned in place. Bearings 8*a*-8*b* and shaft 7 are installed to the central through hole 43 of impeller 3 and rotor 4, integrally formed with each other. Thereafter, the sub-assembly of shaft 7, bearings 8*a*-8*b*, and impeller 3 and rotor 4 is inserted through the central opening 61*c* of lid member 61 into the fluid-tight partition wall member 62, until the large-diameter portion 7*b* of shaft 7 is press-fitted into the shaft press-fit recess 60*b* of housing member 60. With the water pump 1 assembled as discussed above, impeller 3 and rotor 4 are rotatably supported by means of the shaft 7 whose large-diameter portion is press-fitted into the shaft press-fit recess 60*b* and the two bearings 8*a*-8*b* press-fitted into the respective bearing accommodation bores 43*a*-43*b* of rotor 4.

Under the assembled state of water pump 1, a rotor chamber 6*a* is formed as an internal space defined or surrounded by the inner periphery of fluid-tight partition wall member 62. As seen in FIG. 2, rotor 4 is rotatably housed in the rotor chamber 6*a*. Also, under the assembled state of water pump 1, that is, with the fluid-tight partition wall member 62 securely retained by both the housing member 60 and the lid member 61, a stator chamber 6*b* is formed as an internal space partitioned by the outer periphery of fluid-tight partition wall member 62, the inside wall surface of lid member 61, and the inner periphery of housing member 60. As seen in FIG. 2, stator 5 is housed in the stator chamber 6*b*. Fluid-tight partition wall member 62 also serves to prevent cooling-water leakage from the rotor chamber 6*a* into the stator chamber 6*b*.

(Impeller)

Impeller 3 has a shroud 31 as well as a hub 32 and a plurality of blades 33 (in the first embodiment, eight blades).

Hub 32 is formed into a substantially disk shape and formed integral with the rotor 4. The disk-shaped hub 32 is driven or rotated on the rotation axis "O" (i.e., the central axis "O" of shaft 7) together with the rotor 4. Also, the disk-shaped hub 32 is formed or configured to extend in a direction perpendicular to the central axis "O". Shroud 31 and rotor 4 are arranged on the opposite sides of the disk-shaped hub 32, such that the shroud 31 is opposed to the hub 32 in the direction of central axis "O". As appreciated from the cross section of FIG. 2, shroud 31 is formed into a substantially disk shape having a central circular opening 31*a* (corresponding to a fluid inlet of the impeller) through which fluid (cooling water) is drawn into the water pump. Blades 33 are formed integral with the disk-shaped hub 32, and also formed as circumferentially equidistant-spaced, spirally-curved blades each extending radially outward from the center (see the front elevation view of FIG. 4). The radially inward ends of blades 33 are arranged on a circle having a diameter less than the inside diameter of the central circular opening 31*a* of shroud 31. A fluid passage defined between the radially outward ends of two adjacent blades 33 serves as a fluid outlet of the impeller (the water pump).

(Mating Faces Welded Together)

Figure 3:
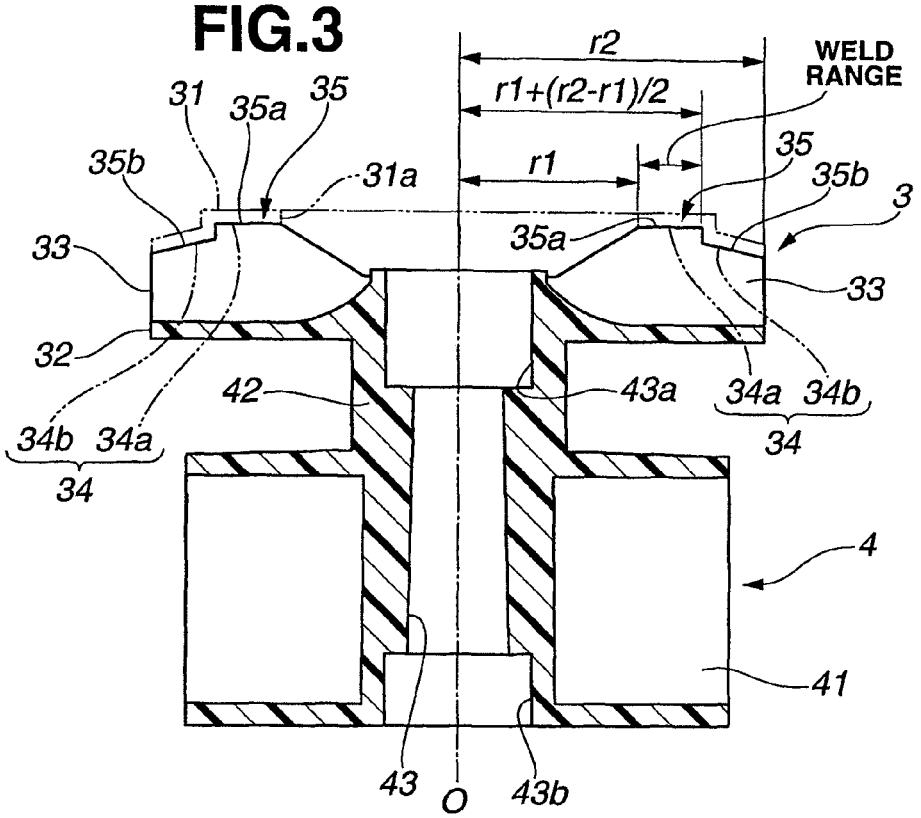
FIG. 3 is a longitudinal cross-section illustrating a hub and each blade of the impeller, and a rotor, constructing the water pump of the first embodiment.
Figure 4:
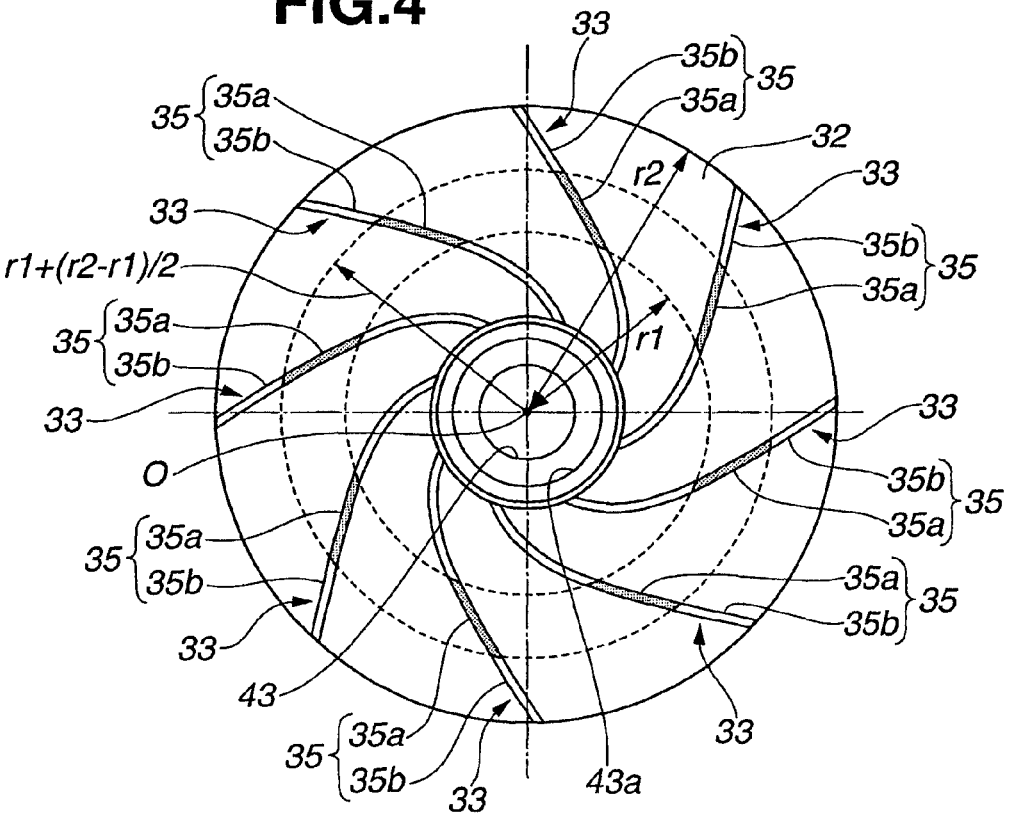
FIG. 4 is a front elevation view illustrating the impeller hub and each of the impeller blades shown in FIG. 3.
Figure 5:
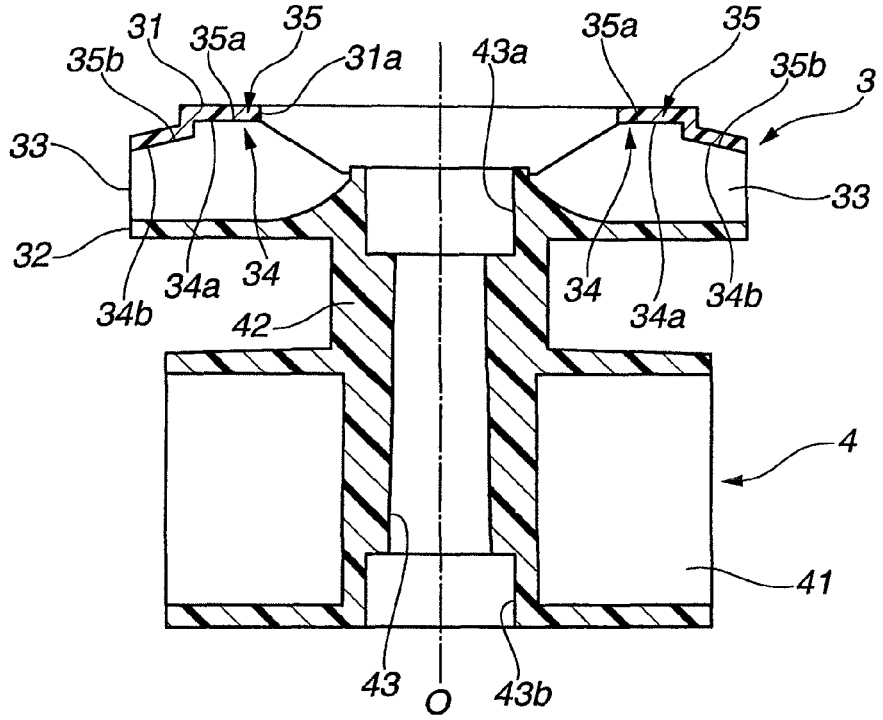
FIG. 5 is a longitudinal cross-sectional view illustrating the impeller and the rotor under a state where a shroud has been welded to each of the blades of the impeller of the first embodiment.

FIG. 3 shows the longitudinal cross-section of the hub 32 and blades 33 of impeller 3 and the rotor 4 of the first embodiment. FIG. 4 shows the front elevation of the hub 32 and blades 33 of impeller 3 of the first embodiment. FIG. 5 shows the longitudinal cross-section of the impeller 3 and rotor 4 of the first embodiment under the state where the shroud 31 has been welded to each of blades 33 of impeller 3 of the first embodiment.

As shown in FIG. 3, a mating face 35 of each of blades 33 with the shroud 31 is set to extend radially outward from the central circular opening 31*a* of shroud 31. In the first embodiment, the mating face 35 is divided or segmented into two regions (two ranges) each having the same radial length, that is, one being a radially inward region 35*a* and the other being a radially outward region 35*b*. In more detail, assuming that the inside diameter of the central circular opening 31*a* of shroud 31 is "2×r1" and the outside diameter of each of blades 33 is "2×r2", the radially inward region 35*a* and the radially outward region 35*b* are set with a circle of a radius "r1+(r2−r1)/2" as a boundary. In the first embodiment, the radially inward region 35*a* of mating face 35 of each of blades 33 is formed as a flat area (a flat surface) perpendicular to the direction of central axis "O", whereas the radially outward region 35*b* of mating face 35 of each of blades 33 is formed as a radially-outward tapered face tapered toward the rotor 4. The radially inward region 35*a* of mating face 35 of each of blades 33 is set as a given weld range when joining the shroud 31 and each of blades 33 together by welding such as ultrasonic-welding.

In a similar manner to the mating face 35 of each of blades 33, as shown in FIG. 5, a mating face 34 of shroud 31 with each of blades 33 is set to extend radially outward from the central circular opening 31*a* of shroud 31. In the first embodiment, the mating face 34 of shroud 31 is divided or segmented into two regions (two ranges) each having the same radial length, that is, one being a radially inward region 34*a* configured to be conformable to the radially inward region 35*a* of each of blades 33 and the other being a radially outward region 34*b* configured to be conformable to the radially outward region 35*b* of each of blades 33. Hence, the radially inward region 34*a* of mating face 34 of shroud 31 is formed as a flat area (a flat surface) perpendicular to the direction of central axis "O", whereas the radially outward region 34*b* of mating face 34 of shroud 31 is formed as a radially-outward tapered face tapered toward the rotor 4. The radially inward region 34*a* of mating face 34 of shroud 31 is set as the given weld range when joining the shroud 31 and each of blades 33 together by welding such as ultrasonic-welding.

The operation and effects of the impeller of the first embodiment are hereunder described in detail.

As previously described, the impeller 3 is a synthetic-resin molded product. A portion of the mating face 34 near the circumference of shroud 31 has a comparatively lower molding accuracy than the central circular opening 31*a* of shroud 31. In a similar manner, a portion of the mating face 35 near the tip of each of blades 33 of impeller 3 has a comparatively lower molding accuracy than the root of each of blades 33. Suppose that the radially outward regions 34*b* and 35*b*, respectively containing the portion of the mating face 34 near the circumference of shroud 31 and the portion of the mating face 35 near the tip of each of blades 33, are also included in the given weld range. In such a case, it is hard to achieve a high dimensional accuracy at the welded portion, thus resulting in a large distortion of the mating faces 34-35, consequently a deteriorated welding accuracy.

In contrast, in the first embodiment, the weld range of the mating face 34 of shroud 31 and the mating face 35 of each of blades 33 is limited to only the radially inward regions 34*a* and 35*a*. That is, the portion of the mating face 34 near the circumference of shroud 31 having a comparatively lower molding accuracy than the central circular opening 31*a* and the portion of the mating face 35 near the tip of each of blades 33 of impeller 3 having a comparatively lower molding accuracy than the root of each of blades 33 are excluded from the given weld range, but only the radially inward regions 34*a* and 35*a* are included in the given weld range. Therefore, it is possible to effectively suppress or reduce a distortion of the mating faces 34-35 within the given weld range, thus ensuring the enhanced/ameliorated welding accuracy.

Additionally, in the first embodiment, the radial length of the radially inward region 34*a* of mating face 34 of shroud 31 is set to be equal to that of the radially outward region 34*b* of mating face 34. In a similar manner, the radial length of the radially inward region 35*a* of mating face 35 of each of blades 33 is set to be equal to that of the radially outward region 35*b* of mating face 35. That is, the radially-inward half (i.e., the radially inward region 34*a*) of mating face 34 of shroud 31 and the radially-inward half (i.e., the radially inward region 35*a*) of mating face 35 of each of blades 33 are set as welding margins, thereby ensuring a strength reliability of impeller 3.

Furthermore, in the first embodiment, the radially inward region 34*a* of mating face 34 of shroud 31 and the radially inward region 35*a* of mating face 35 of each of blades 33 are formed or configured to extend in a direction perpendicular to the direction of central axis "O". When welding the shroud 31 onto each of blades 33, the welding direction, in which a pressing force (a load) is applied to the mating faces 34-35, accords with the direction of central axis "O". Suppose that a portion of mating face 34 of shroud 31 and a portion of mating face 35 of each of blades 33, included in the given weld range, are formed or configured so as not to be perpendicular to the direction of central axis "O". In such a case, there is an increased tendency for a welding strength/load to be undesirably dispersed, thus resulting in a decrease in adhering/welding strength. In contrast, in the first embodiment, the radially inward region 34*a* of mating face 34 of shroud 31 and the radially inward region 35*a* of mating face 35 of each of blades 33, included in the given weld range, are formed or configured to extend in a direction perpendicular to the welding direction (that is, the direction of central axis "O"). Hence, it is possible to effectively suppress the welding strength/load to be dispersed, thereby enhancing the adhering/welding strength. Additionally, the flat surface (i.e., the radially inward regions 34*a*-35*a*) perpendicular to the direction of central axis "O" is superior to the tapered surface in enhanced molding accuracy. Thus, the radially inward regions 34*a*-35*a*, included in the given weld range and formed or configured to be perpendicular to the welding direction (i.e., the direction of central axis "O"), contribute to the improved welding accuracy.

The impeller of the first embodiment provides the following effects.

(1) In the impeller 3 having the hub 32 configured to be rotated on the central axis "O", the shroud 31 formed to be opposed to the hub 32 in the direction of central axis "O" and having the central opening 31*a* serving as a fluid inlet (a cooling-water inlet), and a plurality of circumferentially-equidistant spaced blades 33 interleaved between the hub 32 and the shroud 31, when the mating face 34 of the shroud 31 with each of blades 33 is divided into a radially inward region 34*a* and a radially outward region 34*b*, and the mating face 35 of each of blades 33 with the shroud 31 is divided into a radially inward region 35*a* and a radially outward region 35*b*, a given weld range is set only in the radially inward region 34*a* of the mating face 34 of the shroud 31 with each of blades 33 and the radially inward region 35*a* of the mating face 35 of each of blades 33 with the shroud 31. Therefore, it is possible to improve the welding accuracy.

(2) Radial lengths of the radially inward region 34*a* and the radially outward region 34*b* of the mating face 34 of the shroud 31 with each of blades 33 are set to be equal to each other, and radial lengths of the radially inward region 35*a* and the radially outward region 35*b* of the mating face 35 of each of blades 33 with the shroud 31 are set to be equal to each other, thereby ensuring a strength reliability of the impeller 3.

(3) The radially inward region 34*a* of the mating face 34 of the shroud 31 with each of blades 33 and the radially inward region 35*a* of the mating face 35 of each of blades 33 with the shroud 31 are formed to extend in a direction perpendicular to the direction of the central axis "O", thereby suppressing the welding strength/load to be dispersed, thereby enhancing the adhering/welding strength.

Second Embodiment

The shape of an impeller 30 of the second embodiment differs from that of the impeller 3 of the first embodiment. The shape of impeller 30 will be hereinafter described in detail with reference to the cross section of FIG. 6, while detailed description of the same component such as the rotor 4 will be omitted because the above description thereon seems to be self-explanatory.

(Mating Faces Welded Together)

Figure 6:
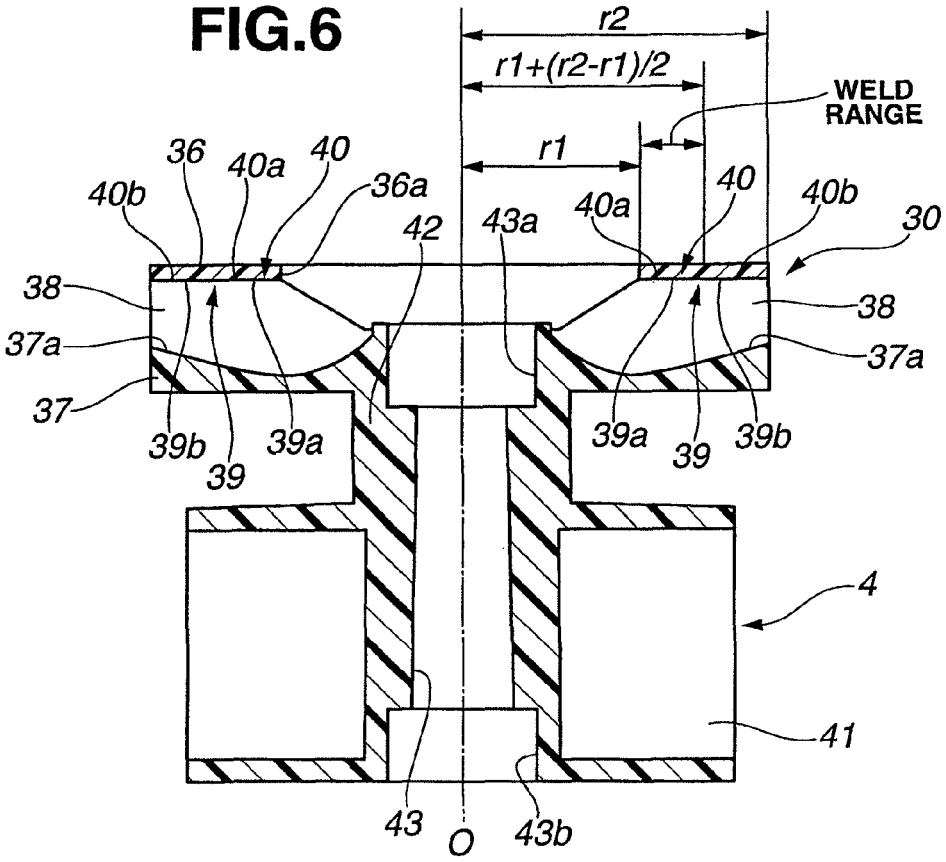
FIG. 6 is a longitudinal cross-sectional view illustrating another type of impeller and the rotor under a state where another type of shroud has been welded to each blade of the impeller of the second embodiment.

FIG. 6 shows the longitudinal cross-section of the impeller 30 and rotor 4 of the second embodiment under the state where another type of shroud has been welded to each blade of impeller 30.

Impeller 30 of the second embodiment includes a shroud 36, a hub 37 and a plurality of blades 38 (in the second embodiment, eight blades).

As shown in FIG. 6, a mating face 40 of each of blades 38 with the shroud 36 is set to extend radially outward from the central circular opening 36*a* of shroud 36. In the second embodiment, the mating face 40 is divided or segmented into two regions (two ranges) each having the same radial length, that is, one being a radially inward region 40*a* and the other being a radially outward region 40*b*. In more detail, assuming that the inside diameter of the central circular opening 36*a* of shroud 36 is "2×r1" and the outside diameter of each of blades 38 is "2×r2", the radially inward region 40*a* and the radially outward region 40*b* are set with a circle of a radius "r1+(r2−r1)/2" as a boundary. In the second embodiment, the radially inward region 40*a* and the radially outward region 40*b* of mating face 40 of each of blades 38 are formed as a continuous flat area (a continuous flat surface) perpendicular to the direction of central axis "O". The radially inward region 40*a* of mating face 40 of each of blades 38 is set as a given weld range when joining the shroud 36 and each of blades 38 together by welding such as ultrasonic-welding.

In a similar manner to the mating face 40 of each of blades 38, as shown in FIG. 6, a mating face 39 of shroud 36 with each of blades 38 is set to extend radially outward from the central circular opening 36*a* of shroud 36. In the second embodiment, the mating face 39 of shroud 36 is divided or segmented into two regions (two ranges) each having the same radial length, that is, one being a radially inward region 39*a* configured to be conformable to the radially inward region 40*a* of each of blades 38 and the other being a radially outward region 39*b* configured to be conformable to the radially outward region 40*b* of each of blades 38. Hence, the radially inward region 39*a* and the radially outward region 39*b* of mating face 39 of shroud 36 are formed as a continuous flat area (a continuous flat surface) perpendicular to the direction of central axis "O". The radially inward region 39*a* of mating face 39 of shroud 36 is set as the given weld range when joining the shroud 36 and each of blades 38 together by welding such as ultrasonic-welding.

By the way, in the second embodiment, the mating face 40 of each of blades 38 with the shroud 36 and the mating face 39 of shroud 36 with each of blades 38 are formed as a flat area (a flat surface). In lieu thereof, the inside face 37*a* of hub 37, facing each of blades 38, is formed as a radially-outward tapered, curved face tapered toward the blades 38, such that the height of each of blades 38 gradually lowers radially outward, thereby ensuring a desired pump performance.

The impeller 30 of the second embodiment constructed as discussed above, can provide the same operation and effects as the first embodiment. That is, the weld range of the mating face 39 of shroud 36 and the mating face 40 of each of blades 38 is limited to only the radially inward regions 39*a* and 40*a*, and therefore it is possible to effectively suppress or reduce a distortion of the mating faces 39-40 within the given weld range, thus ensuring the enhanced welding accuracy. Additionally, in the second embodiment, the radial length of the radially inward region 39*a* of mating face 39 of shroud 36 is set to be equal to that of the radially outward region 39*b* of mating face 39. In a similar manner, the radial length of the radially inward region 40*a* of mating face 40 of each of blades 38 is set to be equal to that of the radially outward region 40*b* of mating face 40. That is, the radially-inward half (i.e., the radially inward region 39*a*) of mating face 39 of shroud 36 and the radially-inward half (i.e., the radially inward region 40*a*) of mating face 40 of each of blades 38 are set as welding margins, thereby ensuring a strength reliability of impeller 30. Furthermore, in the second embodiment, the mating face 39 of shroud 36 and the mating face 40 of each of blades 38 are formed or configured to extend in a direction perpendicular to the direction of central axis "O". Hence, it is possible to effectively suppress the welding strength/load to be dispersed, thereby enhancing the adhering/welding strength.

Third Embodiment

The shape of an impeller 50 of the third embodiment differs from that of the impeller 3 of the first embodiment, in that the hub 32 of impeller 50 of the third embodiment is formed with a plurality of stiffening ribs 51. The cross-sectional structure of impeller 50 will be hereinafter described in detail with reference to the cross section of FIG. 7, while detailed description of the same component such as the rotor 4 will be omitted because the above description thereon seems to be self-explanatory.

(Impeller)

Figure 7:
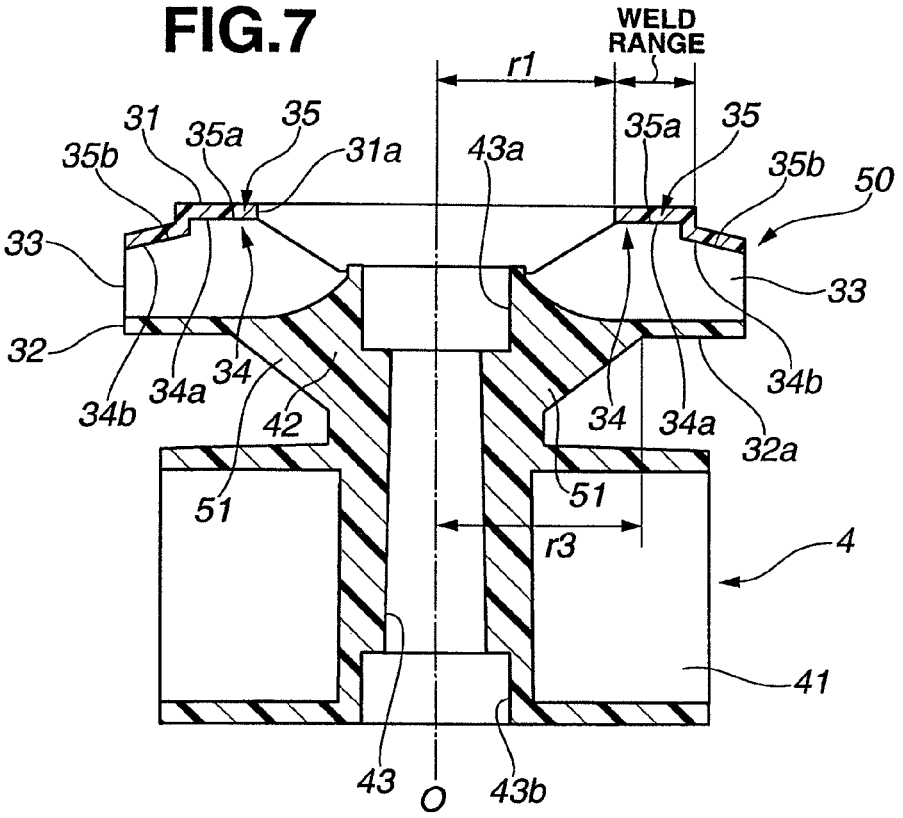
FIG. 7 is a longitudinal cross-sectional view illustrating another type of impeller and the rotor under a state where the shroud having the same cross section as the first embodiment has been welded to each of the blades of the impeller of the third embodiment.

FIG. 7 shows the longitudinal cross-section of the impeller 50 and rotor 4 of the third embodiment under the state where the shroud 31 having the same cross section as the first embodiment has been welded to each of blades 33 of impeller 50.

As shown in FIG. 7, the impeller 50 of the third embodiment has a plurality of circumferentially equidistant-spaced stiffening ribs (a thick-walled portion) 51, each of which is formed to radially extend from the small-diameter portion 42 formed between the impeller 50 and the rotor 4 to the outside face 32*a* of hub 32 (the underside of hub 32, viewing FIG. 7), facing apart from each of blades 33. The radially outward end of each of stiffening ribs 51 is formed to protrude radially outward than the central circular opening 31*a* of shroud 31, such that the diameter of the circle circumferentially passing through the radially outward ends of the plurality of circumferentially equidistant-spaced stiffening ribs 51 is greater than the inside diameter "2×r1" of the central circular opening 31*a* of shroud 31. That is, the radially outward ends of stiffening ribs 51 are located radially outward than the radially inward end of the radially inward region 35*a* (i.e., the given weld range) of the mating face 35 of each of blades 33 with the shroud 31.

As discussed above, in the third embodiment, the hub 32 is formed with the plurality of stiffening ribs 51 such that the radially outward ends of stiffening ribs 51 further protrude radially outward than the radially inward end of the given weld range. Therefore, when joining the shroud 31 and each of blades 33 together by welding such as ultrasonic-welding, a part of a pressing force (a load), applied to the mating faces 34-35, can be received by these stiffening ribs 51. Hence, it is possible to suppress an undesired distortion of the mating faces 34-35 during welding, thereby enhancing the adhering/welding strength.

The impeller of the third embodiment provides the following effect, in addition to the effects (1)-(3) of the first embodiment.

(4) The hub 32 has stiffening ribs 51 (a thick-walled portion) formed on the outside face 32*a* of hub 32, facing apart from each of blades 33 and configured to protrude radially outward than the radially inward end of the given weld range. Hence, it is possible to suppress an undesired distortion of the mating faces 34-35 during welding, thereby enhancing the adhering/welding strength.

Fourth Embodiment

The shape of an impeller 52 of the fourth embodiment differs from that of the impeller 3 of the first embodiment, in that a small-diameter portion 53 formed between the impeller 52 and the rotor 4 of the fourth embodiment is large-sized. The cross-sectional structure of impeller 52 will be hereinafter described in detail with reference to the cross section of FIG. 8, while detailed description of the same component such as the rotor 4 will be omitted because the above description thereon seems to be self-explanatory.

(Impeller)

Figure 8:
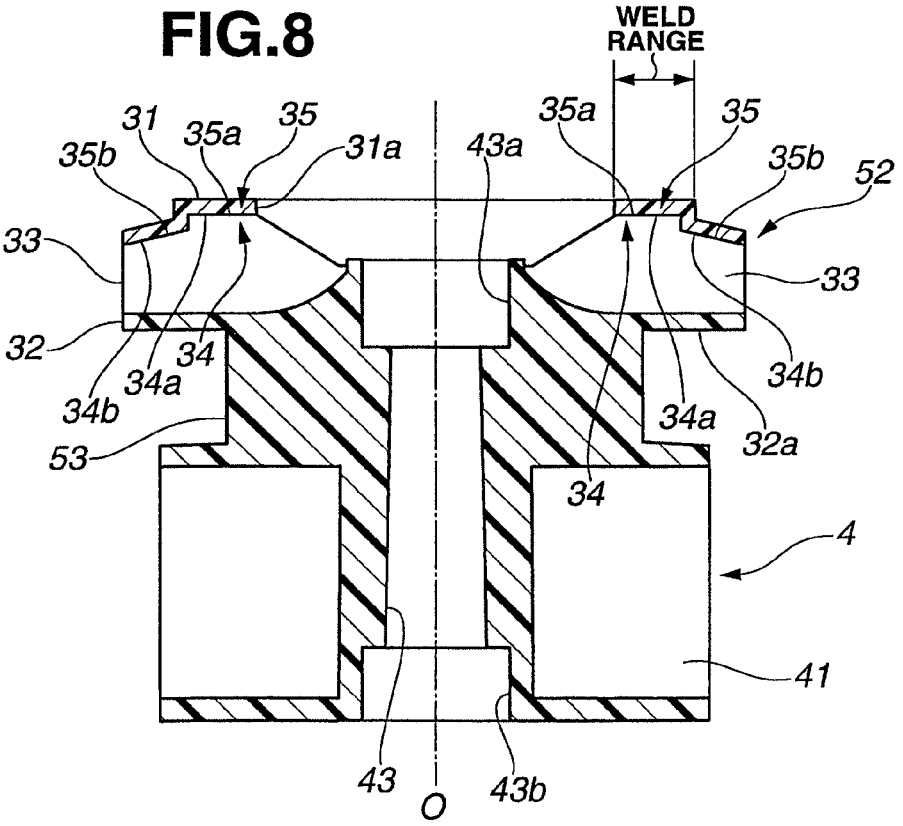
FIG. 8 is a longitudinal cross-sectional view illustrating another type of impeller and the rotor under a state where the shroud having the same cross section as the first embodiment has been welded to each of the blades of the impeller of the fourth embodiment.

FIG. 8 shows the longitudinal cross-section of the impeller 52 and rotor 4 of the fourth embodiment under the state where the shroud 31 having the same cross section as the first embodiment has been welded to each of blades 33 of impeller 52.

As shown in FIG. 8, the outside diameter of small-diameter portion 53 formed between the impeller 52 and the rotor 4 of the fourth embodiment is dimensioned to be greater than that of small-diameter portion 42 formed between the impeller 3 and the rotor 4 of the first embodiment. The circumference of small-diameter portion 53 is formed to further expand diametrically than the central circular opening 31*a* of shroud 31, such that the outside diameter of small-diameter portion 53 is greater than the inside diameter "2×r1" of the central circular opening 31*a* of shroud 31. That is, the circumference of small-diameter portion 53 is located radially outward than the radially inward end of the radially inward region 35*a* (i.e., the given weld range) of mating face 35 of each of blades 33 with the shroud 31. That is, in the fourth embodiment, the diametrically-expanded small-diameter portion 53 serves as a thick-walled portion.

As discussed above, in the fourth embodiment, the circumference of small-diameter portion 53 is formed or configured radially outward than the radially inward end of the given weld range. Therefore, when joining the shroud 31 and each of blades 33 together by welding such as ultrasonic-welding, a part of a pressing force (a load), applied to the mating faces 34-35, can be received by small-diameter portion 53. Hence, it is possible to suppress an undesired distortion of the mating faces 34-35 during welding, thereby enhancing the adhering/welding strength. As appreciated, the impeller 52 of the fourth embodiment shown in FIG. 8 can provide the same operation and effects as the impeller 50 of the third embodiment shown in FIG. 7.

Fifth Embodiment

The fifth embodiment differs from the first embodiment in that each blade of an impeller 54 of the fifth embodiment has been formed integral with a shroud. The cross-sectional structure of impeller 54 will be hereinafter described in detail with reference to the cross section of FIG. 9, while detailed description of the same component such as the rotor 4 will be omitted because the above description thereon seems to be self-explanatory.

(Impeller)

Figure 9:
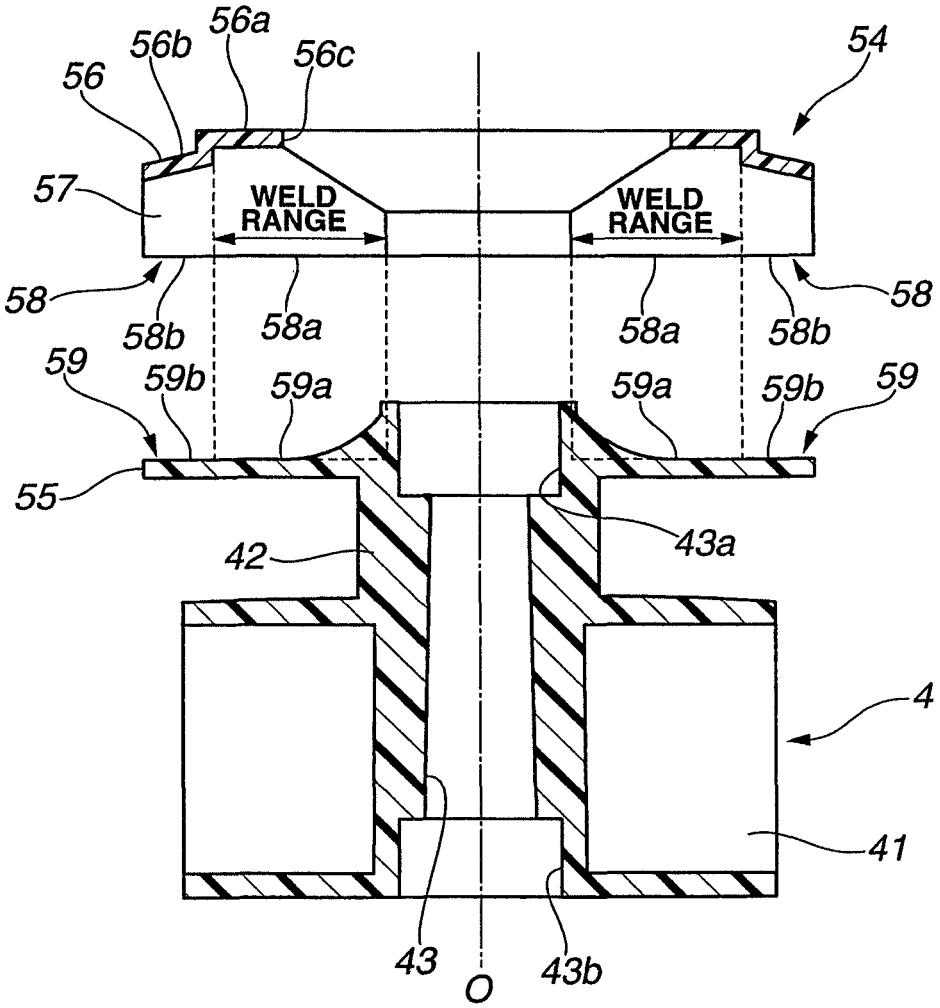
FIG. 9 is a longitudinal cross-sectional view illustrating another type of impeller and the rotor, before each blade of the impeller of the fifth embodiment is welded to another type of hub.

FIG. 9 shows the longitudinal cross-section of the impeller 54 and rotor 4 of the fifth embodiment before each blade of the impeller 54 is welded to another type of hub.

As shown in FIG. 9, the impeller 54 of the fifth embodiment has a hub 55 as well as a shroud 56 and a plurality of blades 57 (in the fifth embodiment, eight blades).

Hub 55 is formed into a substantially disk shape perpendicular to the direction of central axis "O".

Shroud 56 is formed into a substantially disk shape comprised of a horizontally-extending flat portion 56*a* perpendicular to the direction of central axis "O" and a radially-outward tapered portion 56*b* tapered toward the rotor 4. The center of horizontally-extending flat portion 56*a* of shroud 56 is formed as a central circular opening 56*c* through which fluid (cooling water) is drawn into the water pump. Each of blades 57 is formed integral with the shroud 56.

(Mating Faces Welded Together)

As shown in FIG. 9, a mating face 58 of each of blades 57 with the hub 55 is set or provided to extend from the radially inward end of each of blades 57 to the radially outward end of each of blades 57. The mating face 58 is configured to be perpendicular to the direction of central axis "O". In the fifth embodiment, the mating face 58 is divided or segmented into two regions (two ranges) each having a different radial length, that is, one being a radially inward region 58*a* and the other being a radially outward region 58*b*. On one hand, the radially inward end of the radially inward region 58*a* of mating face 58 of each of blades 57 with the hub 55 is located radially inward than the central circular opening 56*c* of shroud 56. On the other hand, the radially outward end of the radially inward region 58*a* is located slightly radially inward than the radially outward end of horizontally-extending flat portion 56*a* of shroud 56. The radially inward region 58*a* of mating face 58 of each of blades 57 is set as a given weld range when joining the hub 55 and each of blades 57 together by welding such as ultrasonic-welding.

In a similar manner to the mating face 58 of each of blades 57, as shown in FIG. 9, a mating face 59 of hub 55 with each of blades 57 is set to extend radially outward from a given radial position corresponding to the radially inward end of the radially inward region 58*a* of mating face 58 of each of blades 57. The mating face 59 is configured to be perpendicular to the direction of central axis "O". In the fifth embodiment, the mating face 59 of hub 55 is divided or segmented into two regions (two ranges) each having a different radial length, that is, one being a radially inward region 59*a* configured to be conformable to the radially inward region 58*a* and the other being a radially outward region 59*b* configured to be conformable to the radially outward region 58*b*. On one hand, the radially inward end of the radially inward region 59*a* of mating face 59 of hub 55 with each of blades 57 is located radially inward than the central circular opening 56*c* of shroud 56. On the other hand, the radially outward end of the radially inward region 59*a* is located slightly radially inward than the radially outward end of horizontally-extending flat portion 56*a* of shroud 56. The radially inward region 59*a* of mating face 59 of hub 55 is set as the given weld range when joining the hub 55 and each of blades 57 together by welding such as ultrasonic-welding.

The operation and effects of the impeller of the fifth embodiment are hereunder described in detail.

As previously described, in the case of the impeller 3 of the first embodiment, each of blades 33 and hub 32 have been formed integral with each other. The impeller 3 is configured such that each of blades 33 and shroud 31 are welded together when assembling and finishing the impeller 3. Thus, the radially inward end of the given weld range cannot be set or located radially inward than the central circular opening 31*a* of shroud 31. By the way, in order to permit or enable a specified amount of fluid (cooling water) drawn through the central circular opening 31*a* into the water pump, the opening area of the central circular opening 31*a* cannot be narrowed thoughtlessly.

In contrast to the above, in the case of the impeller 54 of the fifth embodiment, each of blades 57 and shroud 56 have been formed integral with each other. The impeller 54 is configured such that hub 55 and each of blades 57 are welded together when assembling and finishing the impeller 54. As discussed previously, the radially inward end of the radially inward region 58*a* of mating face 58 of each of blades 57 with the hub 55 is located radially inward than the central circular opening 56*c* of shroud 56, and also the radially inward end of the radially inward region 59*a* of mating face 59 of hub 55 with each of blades 57 is located radially inward than the central circular opening 56*c* of shroud 56. That is, it is possible to enlarge the given weld range radially inward than the central circular opening 56*c*. The radially inward portion of hub 55 has a comparatively higher molding accuracy than the radially outward portion of hub 55. In a similar manner, the radially inward portion of each of blades 57 has a comparatively higher molding accuracy than the radially outward portion of each of blades 57. Hence, as compared to the configuration of impeller 3 of the first embodiment, in the case of the configuration of impeller 54 of the fifth embodiment, it is possible to more effectively suppress or reduce a distortion of the mating faces 58-59 within the given weld range, thus more certainly enhancing the welding accuracy.

Additionally, in the fifth embodiment, the radially inward region 58*a* of mating face 58 of each of blades 57 with the hub 55 and the radially inward region 59*a* of mating face 59 of hub 55 with each of blades 57 are formed or configured to extend in a direction perpendicular, to the direction of central axis "O". When welding each of blades 57 onto the hub 55, the welding direction, in which a pressing force (a load) is applied to the mating faces 58-59, accords with the direction of central axis "O". Suppose that a portion of mating face 58 of each of blades 57 and a portion of mating face 59 of hub 55, included in the given weld range, are formed or configured so as not to be perpendicular to the direction of central axis "O". In such a case, there is an increased tendency for a welding strength/load to be undesirably dispersed, thus resulting in a decrease in adhering/welding strength. In contrast, in the fifth embodiment, the radially inward region 58*a* of mating face 58 of each of blades 57 and the radially inward region 59*a* of mating face 59 of hub 55, included in the given weld range, are formed or configured to extend in a direction perpendicular to the welding direction (that is, the direction of central axis "O"). Hence, it is possible to effectively suppress the welding strength/load to be dispersed, thereby enhancing the adhering/welding strength. Additionally, the flat surface (i.e., the radially inward regions 58*a*-59*a*) perpendicular to the direction of central axis "O" is superior to the tapered surface in enhanced molding accuracy. Thus, the radially inward regions 58*a*-59*a*, included in the given weld range and formed or configured to be perpendicular to the welding direction (i.e., the direction of central axis "O"), contribute to the improved welding accuracy.

The impeller of the fifth embodiment provides the following effects.

(5) In the impeller 54 having the hub 55 configured to be rotated on the central axis "O", the shroud 56 formed to be opposed to the hub 55 in the direction of central axis "O" and having the central opening 56*c* serving as a fluid inlet (a cooling-water inlet), and a plurality of circumferentially-equidistant spaced blades 57 interleaved between the hub 55 and the shroud 56, when the mating face 58 of each of blades 57 with the hub 55 is divided into a radially inward region 58*a* and a radially outward region 58*b*, and the mating face 59 of the hub 55 with each of blades 57 is divided into a radially inward region 59*a* and a radially outward region 59*b*, a given weld range is set only in the radially inward region 58*a* of the mating face 58 of each of blades 33 with the hub 55 and the radially inward region 59*a* of the mating face 59 of the hub 55 with each of blades 57. Therefore, it is possible to permit the given weld range to be enlarged radially inward than the central circular opening 56*c* of shroud 56 in the case of the configuration of impeller 54 of the fifth embodiment, in comparison with the configuration of impeller 3 of the first embodiment that the shroud 31 and each of blades 33 are welded together. Thus, in the fifth embodiment, it is possible to more certainly enhance the welding accuracy.

(6) The radially inward region 58*a* of the mating face 58 of each of blades 57 with the hub 55 and the radially inward region 59*a* of the mating face 59 of the hub 55 with each of blades 57 are formed to extend in a direction perpendicular to the direction of the central axis "O", thereby suppressing the welding strength/load to be dispersed, thereby enhancing the adhering/welding strength.

By the way, in the first to fourth embodiments, the radial length of each of the radially inward regions (34*a*-35*a*; 39*a*-40*a*) of mating faces (34-35; 39-40) is set to be equal to that of each of the radially outward regions (34*b*-35*b*; 39*b*-40*b*) of mating faces (34-35; 39-40). In lieu thereof, the radial length of each of the radially inward regions may be set to an arbitrary radial length sufficient to ensure a strength reliability of the impeller and/or a weld-accuracy reliability of mating faces of the shroud with each of the blades.

The shape of the previously-discussed thick-walled portion (e.g., stiffening ribs 51) may be set to an arbitrary shape that the thick-walled portion is formed on the outside face of the hub, facing apart from each of the blades and configured to protrude radially outward than the radially inward end of the given weld range.

Also, the thick-walled portion (a plurality of stiffening ribs 51) of the third embodiment or the thick-walled portion (a diametrically-expanded small-diameter portion 53) of the fourth embodiment may be combined with the configuration of impeller 54 and rotor 4 of the fifth embodiment of FIG. 9.

The entire contents of Japanese Patent Application Nos. 2012-211793 (filed Sep. 26, 2012) and 2013-047669 (filed Mar. 11, 2013) are incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. An impeller comprising:

a hub configured to be rotated on a central axis of a rotor;

a shroud formed to be opposed to the hub in a direction of the central axis and having a central opening serving as a fluid inlet; and a plurality of circumferentially-equidistant spaced blades interleaved between the hub and the shroud, wherein, when a mating face of the shroud with each of the blades is divided into a radially inward region and a radially outward region, and a mating face of each of the blades with the shroud is divided into a radially inward region and a radially outward region, a given weld range is set only in the radially inward region of the mating face of the shroud with each of the blades and the radially inward region of the mating face of each of the blades with the shroud, wherein the radially inward region of the mating face of the shroud with each of the blades and the radially inward region of the mating face of each of the blades with the shroud are formed as flat mating surfaces extending in a direction perpendicular to the direction of the central axis, wherein the radially outward region of the mating face of the shroud with each of the blades and the radially outward region of the mating face of each of the blades with the shroud are formed as radially-outward tapered mating surfaces tapered toward the rotor, and wherein the given welded range is a welded area defined between a radius r1 of the central opening of the shroud and a radius r1+(r2−r1)/2 of a boundary between the flat mating surfaces and the tapered mating surfaces, where an inside diameter of the central opening of the shroud is denoted by 2×r1, and an outside diameter of each of the blades is denoted by 2×r2.

2. An impeller according to claim 1, wherein:

radial lengths of the radially inward region and the radially outward region of the mating face of the shroud with each of the blades are set to be equal to each other, and radial lengths of the radially inward region and the radially outward region of the mating face of each of the blades with the shroud are set to be equal to each other.

3. An impeller according to claim 1, wherein:

the hub has a thick-walled portion formed on an outside face of the hub, facing apart from each of the blades and configured to protrude radially outward than a radially inward end of the given weld range.

4. An impeller according to claim 2, wherein:

the hub has a thick-walled portion formed on an outside face of the hub, facing apart from each of the blades and configured to protrude radially outward than a radially inward end of the given weld range.

5. An electric-motor driven water pump having an impeller according to claim 1, the electric-motor driven water pump comprising:

a brushless motor having the rotor and a stator; and a housing configured to rotatably house therein both the rotor and the impeller, wherein the impeller is located on either side of the rotor in a rotation-axis direction of the rotor and has a fluid inlet formed at a center and a fluid outlet formed at an outer periphery.

6. An electric-motor driven water pump having an impeller according to claim 2, the electric-motor driven water pump comprising:

a brushless motor having the rotor and a stator; and a housing configured to rotatably house therein both the rotor and the impeller, wherein the impeller is located on either side of the rotor in a rotation-axis direction of the rotor and has a fluid inlet formed at a center and a fluid outlet formed at an outer periphery.

* * * * *